US009982904B2

(12) United States Patent
Hinokuma et al.

(10) Patent No.: US 9,982,904 B2
(45) Date of Patent: May 29, 2018

(54) AIR CONDITIONING SYSTEM

(71) Applicant: DAIKIN INDUSTRIES, LTD., Osaka-shi, Osaka (JP)

(72) Inventors: Ryohei Hinokuma, New York, NY (US); Hirotada Yamada, Osaka (JP); Yoshiyuki Uemura, Houston, TX (US)

(73) Assignee: Daikin Industries, Ltd., Osaka (JP)

( * ) Notice: Subject to any disclaimer, the term of this patent is extended or adjusted under 35 U.S.C. 154(b) by 243 days.

(21) Appl. No.: 14/933,511

(22) Filed: Nov. 5, 2015

(65) Prior Publication Data

US 2016/0131378 A1 May 12, 2016

Related U.S. Application Data

(60) Provisional application No. 62/076,566, filed on Nov. 7, 2014.

(51) Int. Cl.

| | |
|---|---|
| ***F25B 1/00*** | (2006.01) |
| ***F25B 49/00*** | (2006.01) |
| ***F24F 11/00*** | (2018.01) |

(52) U.S. Cl.

CPC ..... *F24F 11/001* (2013.01); *F24F 11/006* (2013.01); *F24F 2011/0046* (2013.01); (Continued)

(58) Field of Classification Search

CPC ..... F24F 11/001; F24F 11/006; F24F 2011/0075; F24F 2011/0063; F24F 2011/0046; F24F 2011/0047

See application file for complete search history.

(56) References Cited

U.S. PATENT DOCUMENTS

2010/0065245 A1* 3/2010 Imada ..... F24F 3/001 165/59
2012/0175966 A1* 7/2012 Nakashima ..... H02J 7/0019 307/86

FOREIGN PATENT DOCUMENTS

JP 2001-201138 A 7/2001
JP 2001201138 A * 7/2001

OTHER PUBLICATIONS

Kawagishi et al., Air Conditioner, Jul. 27, 2001, JP2001201138A, Whole Document.*

* cited by examiner

*Primary Examiner* — Larry Furdge
(74) *Attorney, Agent, or Firm* — Global IP Counselors, LLP

(57) ABSTRACT

An air conditioning system includes an electrically run air conditioner with a compressor, a storage battery that charges and supplies electric power, a demand receiver, an air-conditioning controller, and a charging controller controlling charging of the storage battery. The demand receiver receives a demand pertaining to a power consumption of the air conditioner during a predetermined period. The air-conditioning controller stores operation-associated information pertaining to operation of the air conditioner and controls the air conditioner. The air-conditioning controller causes the air conditioner to perform precooling and/or reduce the power consumption of the air conditioner in the predetermined period based on the demand and an amount of charge of the storage battery. The charging controller control the charging of the storage battery so that the storage battery reaches, at the start of the predetermined period, a state of charge determined based on the demand and the operation-associated information.

11 Claims, 3 Drawing Sheets

(52) U.S. Cl.
CPC ..... *F24F 2011/0047* (2013.01); *F24F 2011/0063* (2013.01); *F24F 2011/0075* (2013.01)

AIR CONDITIONING SYSTEM

FIELD OF THE INVENTION

The present invention relates to an air conditioning system. More specifically, the present invention relates to an air conditioning system including an air conditioner run by electric power and a storage battery for charging electric power and supplying stored electric power to the air conditioner.

BACKGROUND

As is indicated in Japanese Laid-open Patent Application No. 2001-201138, there is a known system including an air conditioner and a storage battery, in which, when a peak cut is requested from an electric power company that supplies electric power to the system, the air conditioner is operated by using the electric power of the storage battery charged during the night so as to ensure the comfort of the user of the air conditioner while complying with the request.

In such a system, keeping the storage battery always fully charged makes it easy to ensure the comfort of the user of the air conditioner while complying with the request for a peak cut.

SUMMARY

However, when the storage battery is always fully charged, situations could arise in which the charged electric power is not utilized very much, depending on the specifics of the peak cut request and/or the operating conditions of the air conditioner. As a result, situations could occur in which unnecessarily charged electric power is needlessly consumed by self-discharge of the storage battery and other factors.

An object of the present invention is to provide an air conditioning system including an air conditioner and a storage battery, in which electric power stored in the storage battery is utilized in the air conditioner in accordance with a demand pertaining to power consumption, wherein unnecessary charging of electric power in the storage battery is prevented and electric power can be efficiently utilized.

An air conditioning system according to a first aspect of the present invention is provided with an air conditioner including a compressor, a storage battery, a demand receiver, an air-conditioning controller, and a charging controller. The air conditioner is run by electric power. The storage battery is configured to charge electric power and to supply stored electric power to the air conditioner. The demand receiver is configured to receive a demand pertaining to a power consumption of the air conditioner during a predetermined period. The air-conditioning controller is configured to store operation-associated information pertaining to the operation of the air conditioner and to control the air conditioner. The charging controller is configured to control the charging of the storage battery. The air-conditioning controller is configured to cause the air conditioner to perform precooling and/or to reduce the power consumption of the air conditioner in the predetermined period as necessary, based on the demand and an amount of charge of the storage battery. The charging controller is configured to control the charging of the storage battery so that the storage battery reaches, at the start of the predetermined period, a state of charge determined based on the demand and the operation-associated information.

In the air conditioning system according to the first aspect of the present invention, because the state of charge of the storage battery is determined based on the demand pertaining to the power consumption of the air conditioner and the operation-associated information pertaining to the operation of the air conditioner, unnecessary charging is prevented and electric power can be efficiently utilized.

An air conditioning system according to a second aspect of the present invention is the air conditioning system according to the first aspect, wherein the demand includes at least one of the following: a length of the predetermined period, a starting time of the predetermined period, and information pertaining to the reduction amount of the power consumption of the air conditioner.

In the air conditioning system according to the second aspect of the present invention, because the state of charge of the storage battery is determined based on the demand including the length and/or starting time of the predetermined period during which the power consumption of the air conditioner is to be reduced, and/or the information pertaining to the reduction amount of the power consumption of the air conditioner, the state of charge of the storage battery can be appropriately determined.

An air conditioning system according to a third aspect of the present invention is the air conditioning system according to the first or second aspect, wherein the operation-associated information includes information pertaining to a set temperature of the air conditioner scheduled for the predetermined period.

In the air conditioning system according to the third aspect of the present invention, because the state of charge of the storage battery is determined based on the set temperature as an operating condition of the air conditioner in the predetermined period, the state of charge of the storage battery can be appropriately determined.

An air conditioning system according to a fourth aspect of the present invention is the air conditioning system according to any of the first through third aspects, wherein the operation-associated information includes at least one of the following: an operating frequency of the compressor, a ratio between ON-time and OFF-time of the compressor, a set temperature of the air conditioner, and a power consumption of the air conditioner in a predetermined time span prior to the predetermined period.

In the air conditioning system according to the fourth aspect, because the state of charge of the storage battery is determined based on the operating condition of the air conditioner prior to the predetermined period, the state of charge of the storage battery can be appropriately determined.

An air conditioning system according to a fifth aspect of the present invention is the air conditioning system according to any of the first through fourth aspects, wherein the charging controller is configured to control at least one of the following: a charging rate of the storage battery, a charging start time of the storage battery, and a charging speed of the storage battery.

In the air conditioning system according to the fifth aspect of the present invention, the state of charge of the storage battery can be appropriately controlled by controlling the charging rate, charging start time, and/or charging speed of the storage battery.

In the air conditioning system according to the first aspect of the present invention, because the state of charge of the storage battery is determined based on the demand pertaining to the power consumption of the air conditioner and the operation-associated information pertaining to the operation of the air conditioner, unnecessary charging is prevented and electric power can be efficiently utilized.

In the air conditioning system according to the second through fourth aspects of the present invention, the state of charge of the storage battery can be appropriately determined.

In the air conditioning system according to the fifth aspect of the present invention, the state of charge of the storage battery can be appropriately controlled.

DETAILED DESCRIPTION OF EMBODIMENT(S)

Embodiments of the present invention are described below with reference to the drawings. The following embodiments are merely examples, and can be modified as appropriate provided that no departure is made from the scope of the invention.

First Embodiment (1) Overall Configuration

Figure 1:
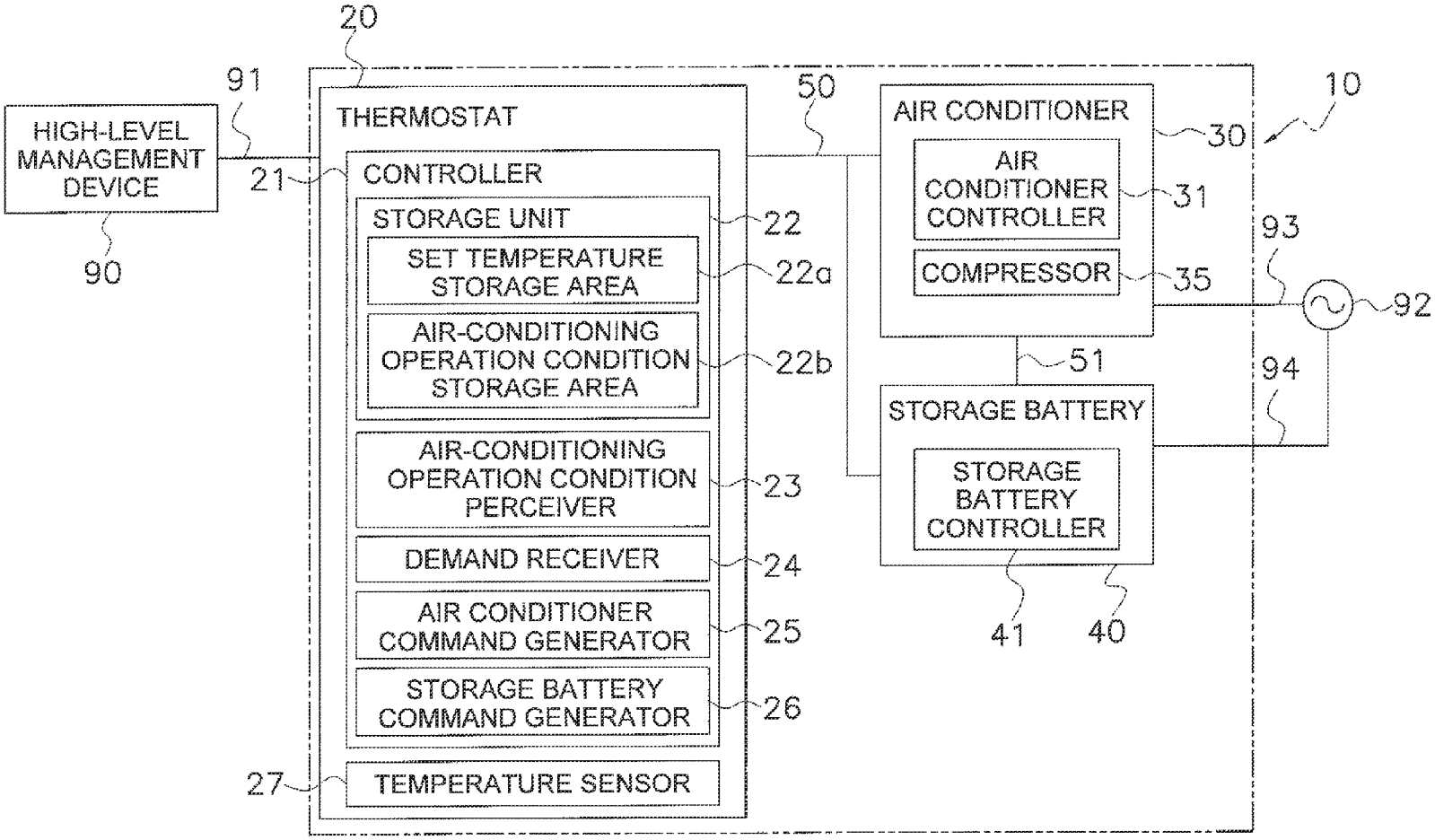
FIG. 1 is an overall schematic diagram of an air conditioning system according to the first embodiment of the present invention.

FIG. 1 is an overall schematic diagram of an air conditioning system 10 according to the first embodiment of the present invention. The air conditioning system 10 is installed in a home in this embodiment. The air conditioning system 10 is not limited thereto and may also be installed in a commercial building, a factory, or the like.

The air conditioning system 10 is primarily provided with a thermostat 20, an air conditioner 30, and a storage battery 40 (see FIG. 1).

In the air conditioning system 10, during a normal period (a period that is not a demand object period described hereinafter), electric power supplied from an electric power company is directly utilized (i.e. electric power stored in the storage battery 40 is not utilized) to operate the air conditioner 30 so that the temperature of the space being air-conditioned by the air conditioner 30 reaches a set temperature stored in the thermostat 20. During the demand object period described hereinafter (a period requested from the high-level management device 90 (see FIG. 1) to suppress the power consumption of the air conditioner 30), the electric power stored in the storage battery 40 is utilized, either in addition to electric power from the electric power company or instead of electric power from the electric power company, to operate the air conditioner 30 so that the temperature of the space being air-conditioned by the air conditioner 30 reaches the set temperature stored in the thermostat 20.

(2) Details

The details of the air conditioning system 10 are described below.

(2-1) Thermostat

The thermostat 20 measures, using a temperature sensor 27 (see FIG. 1), the temperature of the space being air-conditioned by the air conditioner 30, and sends a command to the air conditioner 30 so that the temperature of the space being air-conditioned by the air conditioner 30 (i.e., the temperature measured by the temperature sensor 27) reaches a set temperature stored in a set temperature storage area 22*a* (see FIG. 1), described hereinafter. The temperature sensor 27 is, for example, a thermistor, but is not limited thereto. Various temperature measuring instruments capable of measuring room temperatures can be applied as the temperature sensor 27.

The thermostat 20 is connected by a communication line 91 with the high-level management device 90 of an electric power company, an electric power aggregator, or the like (see FIG. 1). The communication line 91 is, for example, an Internet line, but is not limited thereto. FIG. 1 depicts the high-level management device 90 as being connected with only one thermostat 20, but in practice the high-level management device 90 may be connected by the communication line 91 with numerous thermostats. The thermostat 20 is also connected by a communication line 50 with the air conditioner 30 and the storage battery 40 of the air conditioning system 10. The communication line 50 is, for example, a dedicated control line, but is not limited thereto. For example, the communication line 50 may be a wireless LAN or the like.

The thermostat 20 has a controller 21 for performing tasks such as creating commands for the air conditioner 30 and the storage battery 40 (see FIG. 1). The controller 21 includes a storage unit 22 (see FIG. 1) configured primarily from read only memory (ROM), random access memory (RAM), and the like. The controller 21 also has a CPU (not shown), and the CPU functions primarily as an air-conditioning operation condition perceiver 23, a demand receiver 24, an air conditioner command generator 25, and a storage battery command generator 26 (see FIG. 1) by executing programs stored in the storage unit 22. An air-conditioning operation condition storage area 22*b* of the storage unit 22 described hereinafter and the air conditioner command generator 25 are an example of an air-conditioning controller.

The storage unit 22, the air-conditioning operation condition perceiver 23, the demand receiver 24, the air conditioner command generator 25, and the storage battery command generator 26 are described in detail below.

(2-1-1) Storage Unit

The storage unit 22 stores the programs executed by the CPU (not shown) of the controller 21. The storage unit 22 has the set temperature storage area 22*a* and the air-conditioning operation condition storage area 22*b* as storage areas for storing operation-associated information pertaining to the operation of the air conditioner 30.

(2-1-1-1) Set Temperature Storage Area

Set temperatures of the air conditioner 30, i.e., target temperatures of the space being air-conditioned by the air conditioner 30 are stored in advance according to day of week and time in the set temperature storage area 22*a*. The set temperatures of the air conditioner 30 stored in the set temperature storage area 22*a* are inputted in advance, for example, by a user of the air conditioner 30 via an input unit (not shown) of the thermostat 20. The set temperatures of the air conditioner 30 stored in the set temperature storage area 22*a* are configured to be variable.

The set temperatures of the air conditioner 30 stored in the set temperature storage area 22*a* need not be information according to day of week and time. For example, the set temperatures of the air conditioner 30 stored in the set temperature storage area 22*a* may be information according to time irrespective of day of week. The set temperatures of the air conditioner 30 stored in the set temperature storage area 22*a* may also, for example, be information according to date and time.

(2-1-1-2) Air-Conditioning Operation Condition Storage Area

The air-conditioning operation condition storage area 22*b* functions as part of the air-conditioning controller. Particularly, the air-conditioning operation condition storage area 22*b* stores information pertaining to the operation condition of the air conditioner 30. Specifically, information pertaining to the operation condition of the air conditioner 30, perceived by the air-conditioning operation condition perceiver 23 described hereinafter, is stored according to time in the air-conditioning operation condition storage area 22*b*.

(2-1-2) Air-Conditioning Operation Condition Perceiver

The air-conditioning operation condition perceiver 23 perceives information periodically transmitted from the air conditioner 30 via the communication line 50, as information pertaining to the operation condition of the air conditioner 30. The air-conditioning operation condition perceiver 23 acquires information pertaining to the operation condition of the air conditioner 30 every minute, but the interval of information acquisition is not limited to one minute.

The information pertaining to the operation condition of the air conditioner 30, perceived by the air-conditioning operation condition perceiver 23, includes, e.g., the set temperature of the air conditioner 30 and the power consumption of the air conditioner 30. The information pertaining to the operation condition of the air conditioner 30 is not limited thereto. For example, the information pertaining to the operation condition of the air conditioner 30, perceived by the air-conditioning operation condition perceiver 23, may include the operating frequency of a compressor 35 of the air conditioner 30, described hereinafter, either instead of the power consumption of the air conditioner 30 or in addition to the power consumption of the air conditioner 30. The air-conditioning operation condition perceiver 23 correlates the perceived information pertaining to the operation condition of the air conditioner 30 with the time of information acquisition, and stores the information in the air-conditioning operation condition storage area 22*b*.

(2-1-3) Demand Receiver

The demand receiver 24 receives a demand pertaining to the power consumption of the air conditioner 30 in a predetermined period (referred to hereinafter simply as the demand), which is transmitted from a high-level management device 90 of an electric power company, an electric power aggregator, or the like. Specifically, the demand is a request from the high-level management device 90 to suppress the power consumption of the air conditioner 30 in a demand request period (a predetermined period).

The demand includes the length of the demand request period, the start time of the demand request period, and the information pertaining to the reduction amount of the power consumption of the air conditioner 30 within the demand request period. The information pertaining to the reduction amount of the power consumption of the air conditioner 30 is the ratio of the electric power the air conditioner 30 is allowed to use during the demand request period relative to the maximum electric power of the air conditioner 30.

The demand is transmitted from the high-level management device 90 to the demand receiver 24 on, e.g., the day before the demand request period, but is not limited thereto. The demand may be transmitted from the high-level management device 90 to the demand receiver 24, e.g., several hours prior to the start time of the demand request period.

The information pertaining to the reduction amount of the power consumption of the air conditioner 30 is not limited to the ratio of the electric power the air conditioner 30 is allowed to use during the demand request period relative to the maximum electric power of the air conditioner 30. The information pertaining to the reduction amount of the power consumption of the air conditioner 30 may be, for example, a value of the electric power allowed to he used during the demand request period, a value of the electric power that should be reduced during the demand request period relative to the maximum electric power of the air conditioner 30, or other information through which it is possible to perceive how much the power consumption of the air conditioner 30 should be reduced during the demand request period.

The information pertaining to the reduction amount of the power consumption of the air conditioner 30 herein is information pertaining to electric power (a momentary value), but is not limited thereto. For example, the information pertaining to the reduction amount of the power consumption of the air conditioner 30 may be the ratio of the average electric power determined from the electric energy the air conditioner 30 is allowed to use in a predetermined time duration (e.g., 30 minutes) in the demand request period, relative to the maximum electric power of the air conditioner 30. The information pertaining to the reduction amount of the power consumption of the air conditioner 30 may also, for example, be the electric energy the air conditioner 30 is allowed to use in a predetermined time duration (e.g., 30 minutes) in the demand request period. The type of the information pertaining to the reduction amount of the power consumption of the air conditioner 30 is preferably determined as appropriate in the high-level management device 90.

(2-1-4) Air Conditioner Command Generator

The air conditioner command generator 25 functions as part of the air-conditioning controller, and controls the air conditioner 30. The air conditioner command generator 25 sends a command to an air conditioner controller 31 of the air conditioner 30, described hereinafter, so that the temperature of the space being air-conditioned by the air conditioner 30; i.e. the value measured by the temperature sensor 27, reaches the set temperature corresponding to the current day of week and time stored in the set temperature storage area 22*a*. Specifically, the air conditioner command generator 25 periodically (e.g., every minute) generates information including the current value measured by the temperature sensor 27 and the set temperature corresponding to the current day of week and time, as a command for the air conditioner controller 31, and transmits this information to the air conditioner controller 31.

The air conditioner command generator 25 causes the air conditioner 30 to perform precooling before the demand request period and/or reduces the power consumption of the air conditioner 30 in the demand request period as necessary (e.g., in a case where it is predicted that the storage battery 40 alone will be unable to compensate for an deficit of electric power supplied from the electric power company when the air conditioner 30 is operated without reducing the power consumption (as requested by the user) in the demand request period), based on the demand received by the demand receiver 24, the amount of charge of the storage battery 40, the operation condition of the air conditioner 30 stored in the air-conditioning operation condition storage area 22*b*, and other factors. The air conditioner command generator 25 may also cause the air conditioner 30 to perform preheating as necessary.

(2-1-5) Storage Battery Command Generator

The storage battery command generator 26 generates a command for controlling the charging and discharging of the storage battery 10.

(a) Charging Control

Figure 2:
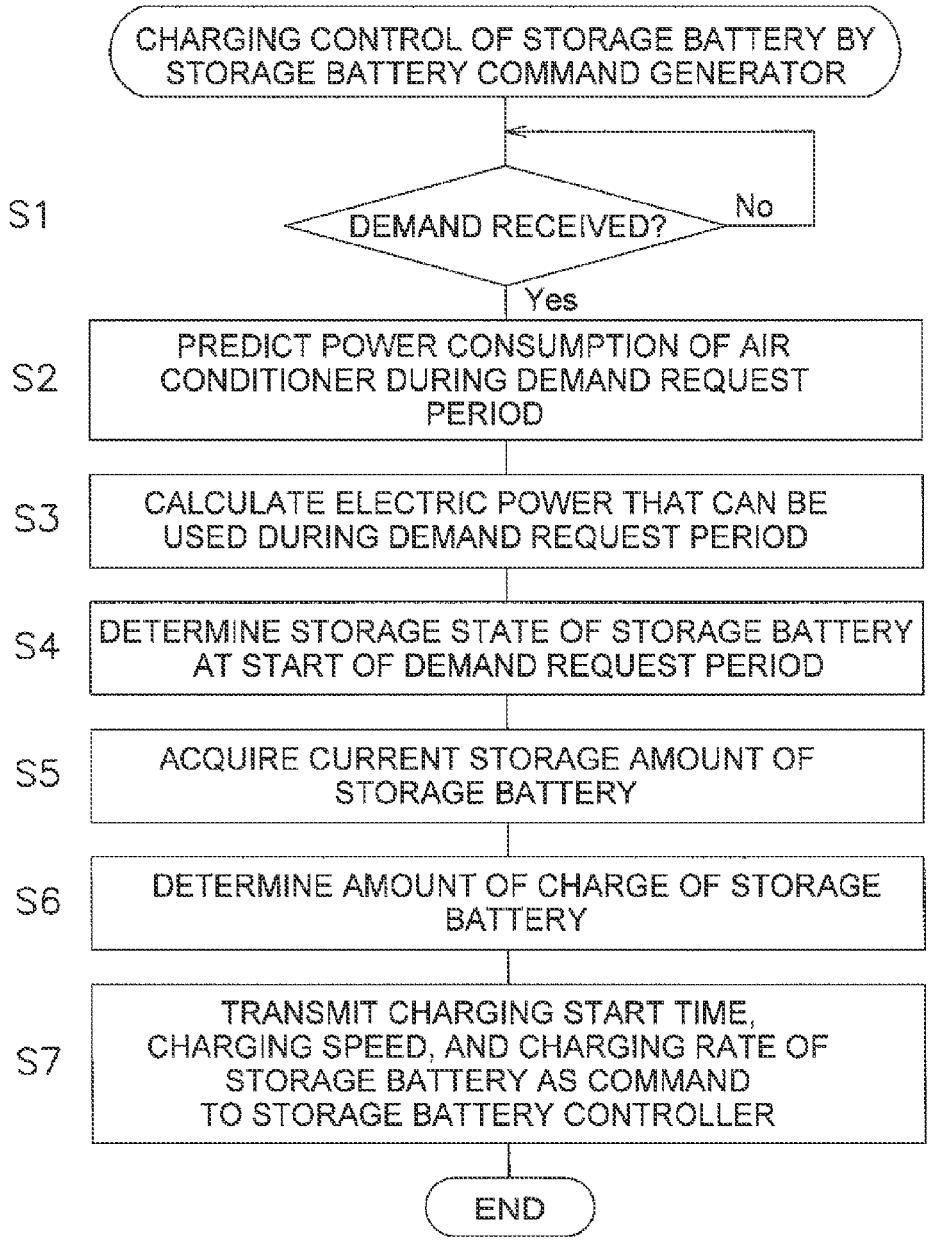
FIG. 2 is a flowchart pertaining to charging control of the storage battery by the storage battery command generator of the air conditioning system of FIG. 1.

The storage battery command generator 26 is one example of a charging controller for controlling the charging of the storage battery 40. The storage battery command generator 26 specifically controls the charging of the storage battery 40 as shown in the flowchart of FIG. 2. The flowchart of FIG. 2 is used as a reference for this description.

First, in step S1, a determination is made as to whether or not the demand receiver 24 has received a demand from the high-level management device 90. Step S1 is repeated until it is determined that the demand receiver 24 has received a demand.

When it is determined in step S1 that the demand receiver 24 has received a demand, the storage battery command generator 26 determines the state of charge of the storage battery 40 at when the demand request period starts, i.e., at the starting time of the demand request period received by the demand receiver 24. The storage battery command generator 26 determines the state of charge of the storage battery 40 based on the demand received by the demand receiver 24, the set temperature of the air conditioner 30 scheduled for the demand request period stored in the set temperature storage area 22*a*, and information pertaining to the operating condition of the air conditioner 30 stored in the air-conditioning operation condition storage area 22*b*.

Specifically; the storage battery command generator 26 first in step S2 predicts the power consumption of the air conditioner 30 during the demand request period (the power consumption of the air conditioner 30 during operation at the set temperature of the air conditioner 30 scheduled for the demand request period). More specifically, the storage battery command generator 26 predicts the power consumption of the air conditioner 30 during the demand request period based on the set temperature of the air conditioner 30 scheduled for the demand request period and information pertaining to past operating conditions of the air conditioner 30. For example, the storage battery command generator 26 predicts the power consumption of the air conditioner 30 during the demand request period by finding a plurality of times at which the set temperature value was equal to the set temperature of the air conditioner 30 during the demand request period from information pertaining to past (e.g., on the day before the demand request period) operating conditions of the air conditioner 30, and calculating the average power consumption of the air conditioner 30 at those times. The method whereby the storage battery command generator 26 predicts the power consumption of the air conditioner 30 during the demand request period is merely exemplified here and is not limited to this example. For example, the storage battery command generator 26 may predict the power consumption of the air conditioner 30 during the demand request period based on the operating frequency of the compressor 35 of the air conditioner 30 instead of the power consumption of the air conditioner 30. The storage battery command generator 26 may also, for example, predict the power consumption of the air conditioner 30 during the demand request period based on the power consumption of the air conditioner 30 of the previous day during the same time span as the demand request period.

Next, in step S3, the storage battery command generator 26 calculates the electric power that the air conditioner 30 can use during the demand request period based on the information pertaining to the reduction amount of the power consumption of the air conditioner 30, which was received by the demand receiver 24.

After step S2 is executed, step S3 is executed, but the execution sequence of these steps may be reversed. Steps S2 and S3 may be executed in parallel.

Next, in step S4, the storage battery command generator 26 calculates the difference between the power consumption of the air conditioner 30 during the demand request period predicted in step S2 and the electric power that the air conditioner 30 can use during the demand request period calculated in step S3, and integrates this difference throughout the demand request period. The electric power that should be stored in the storage battery 40 is thereby calculated, and the storage state of the storage battery 40 at the start of the demand request period is determined. This method of determining the storage state of the storage battery 40 at the start of the demand request period is one example. The storage battery command generator 26 may, for example, determine the storage state of the storage battery 40 at the start of the demand request period by multiplying a predetermined safety factor by the difference between the power consumption of the air conditioner 30 during the demand request period predicted in step S2 and the electric power that the air conditioner 30 can use during the demand request period calculated in step S3.

Next, in step S5, the storage battery command generator 26 acquires the current storage amount of the storage battery 40 from the storage battery 40 via the communication line 50.

In step S6, the storage battery command generator 26 determines the amount of charge of the storage battery 40 based on the current storage amount of the storage battery 40 and the storage state (storage amount) of the storage battery 40 at the start of the demand request period determined in step S4.

Next, in step S7, the storage battery command generator 26 generates information including the charging start time, the charging speed, and the charging rate (an index of the amount of charge of the storage battery 40 defining 100% as when the storage battery 40 is fully charged) of the storage battery 40, as a command for the storage battery 40, and transmits this information to a storage battery controller 41 of the storage battery 40. The charging speed of the storage battery 40 can be varied between two stages: e.g., normal speed and high speed. The storage battery command generator 26 first determines the charging speed based on, e.g., the remaining time duration until the starting time of the demand request period and the electric energy that should be charged from now on in the storage battery 40 (the charging rate of the storage battery 40), and determines the charging start time at which charging can be ended until the start of the demand request period based on this charging speed.

The information included in the command for the storage battery 40 of the storage battery command generator 26 is exemplified here and is not limited to this example. For example, when the storage battery controller 41 of the storage battery 40 has a function in which the charging rate of the storage battery 40 and the starting time of the demand request period is to be designated and the storage battery 40 is automatically charged up to the designated charging rate by the starting time of the demand request period, the storage battery command generator 26 may transmit the charging rate of the storage battery 40 and the starting time of the demand request period as commands for the storage battery 40 of the storage battery command generator 26.

(b) Discharging Control

The storage battery command generator 26 generates a command for controlling the discharging of the storage battery 40 in the following manner. The storage battery command generator 26 generates information including the starting time of the demand request period and the length of the demand request period as a command pertaining to the discharging of the storage battery 40, based on the demand received by the demand receiver 24, and transmits this information to the storage battery controller 41.

(2-2) Air Conditioner

The air conditioner 30 is connected by an electric power line 93 with a power source 92 (see FIG. 1) supplied by the electric power company. The air conditioner 30 is also connected with the storage battery 40 by an electric power line 51 (see FIG. 1). The air conditioner 30 runs by receiving a supply of electric power from the power source 92 supplied by the electric power company, and/or from the storage battery 40.

The air conditioner 30 is a vapor-compression air-conditioning apparatus. The air conditioner 30 is provided with an inverter-type compressor 35, and indoor heat exchanger, outdoor heat exchanger, and expansion valve which are not shown. In the air conditioner 30, a refrigeration cycle is repeated in which refrigerant compressed by the compressor 35 releases heat in either the indoor heat exchanger or the outdoor heat exchanger, the refrigerant is depressurized in the expansion valve and evaporated in the other heat exchanger, and the refrigerant is drawn back into the compressor 35, whereby the space being air-conditioned is cooled or warmed. The air-cooling operation and air-warming operation of the air conditioner 30 are switched by controlling the direction of refrigerant flow and changing the use of the indoor heat exchanger between an evaporator and a condenser.

The air conditioner 30 has an air conditioner controller 31. The air conditioner controller 31 controls the air conditioner 30 in accordance with a command (information including the current room temperature (the temperature measured by the temperature sensor 27 of the thermostat 20) and the current set temperature transmitted from the air conditioner command generator 25 of the thermostat 20. More specifically, the air conditioner controller 31 controls the operating frequency and/or the turning on and off of the compressor 35 based on the degree of divergence between the current room temperature and the current set temperature, and/or the values measured by sensors provided to various locations of the air conditioner 30. The air conditioner controller 31 controls the operating frequency of the compressor 35 and other parameters in accordance with the degree of divergence between the current room temperature and the current set temperature, regardless of whether an electric power supply is received from the power source 92 or an electric power supply is received from the storage battery 40.

(2-3) Storage Battery

The storage battery 40 is connected by an electric power line 94 with the power source 92 of the electric power company. The storage battery 40 is also connected with the air conditioner 30 by the electric power line 51. The storage battery 40 charges electric power by receiving an electric power supply from the power source 92 supplied by the electric power company, and supplies the stored electric power to the air conditioner 30.

A lead storage battery, a lithium ion storage battery, a nickel metal hydride storage battery, an air battery, and various other storage batteries can be applied as the storage battery 40.

The storage battery 40 has a storage battery controller 41 for receiving a command from the storage battery command generator 26 and controlling the charging and discharging of the storage battery 40.

Information including the charging start time, charging speed, and charging rate of the storage battery 40 is transmitted from the storage battery command generator 26 to the storage battery controller 41 as a command for controlling the charging of the storage battery 40. The storage battery controller 41 executes the charging of the storage battery 40 based on the command of the storage battery command generator 26. The charging speed of the storage battery 40 herein can be switched between normal speed and high speed, but is not limited thereto. The charging speed of the storage battery 40 may be switched among three or more stages, or the charging speed of the storage battery 40 may be unswitchable (fixed). When the charging speed of the storage battery 40 is unswitchable, the command for controlling the charging of the storage battery 40 transmitted by the storage battery command generator 26 may not include information pertaining to the charging speed of the storage battery 40.

Information including the starting time of the demand request period and the length of the demand request period is transmitted from the storage battery command generator 26 to the storage battery controller 41 as a command for controlling the discharging of the storage battery 40. Based on the command of the storage battery command generator 26, the storage battery controller 41 supplies electric power from the storage battery 40 to the air conditioner 30 to compensate for insufficient electric power supply from the power source 92, in a case when electric power supply from the power source 92 is insufficient for operating the air conditioner 30 from the start to the end of the demand request period.

(3) Basic Actions of Air Conditioning System

The basic actions of the air conditioning system 10 shall be described.

In the air conditioning system 10, set temperatures of the air conditioner 30 according to day of week and time are stored in the set temperature storage area 22*a* of the thermostat 20. The thermostat 20 periodically generates, as a command for the air conditioner controller 31, information including the current room temperature measured by the temperature sensor 27 and the set temperature corresponding to the current day of week and time stored in the set temperature storage area 22*a* for the air conditioner controller 31 of the air conditioner 30, and transmits this information to the air conditioner controller 31. The air conditioner controller 31 controls the operating frequency and/or the turning on and off of the compressor 35 of the air conditioner 30 based on the current room temperature and current set temperature transmitted from the thermostat 20, and the values measured by sensors provided to various locations of the air conditioner 30.

The demand receiver 24 of the thermostat 20 receives a demand from the high-level management device 90. The storage battery command generator 26 of the thermostat 20 determines the state of charge of the storage battery 40 at the start of the demand request period based on the received demand and operation-associated information (the set temperature of the air conditioner 30 stored in the set temperature storage area 22*a*, and information pertaining to the operating condition of the air conditioner 30 stored in the air-conditioning operation condition storage area 22*b*) pertaining to the operation of the air conditioner 30 stored in the storage unit 22. The storage battery command generator 26 also transmits a command to the storage battery controller 41 so that the determined state of charge of the storage battery 40 is achieved (for the charging control of the storage battery 40 by the storage battery command generator 26, refer to the flowchart of FIG. 2). The storage battery command generator 26 of the thermostat 20 also transmits a command to the storage battery controller 41 so that electric power is supplied from the storage battery 40 to the air conditioner 30 during the demand request period. The air conditioner 30 is basically operated without reducing the power consumption of the air conditioner 30 even during the demand request period. Insufficient electric power supply from the power source 92 to the air conditioner 30 is compensated by the storage battery 40.

However, the air conditioner command generator 25 causes the air conditioner 30 to perform precooling before the demand request period and/or reduces the power consumption of the air conditioner 30 in the demand request period as necessary, based on the demand received by the demand receiver 24, the amount of charge of the storage battery 40, the operating condition of the air conditioner 30 stored in the air-conditioning operation condition storage area 22*b*, and other factors.

(4) Characteristics (4-1)

The air conditioning system 10 of the present embodiment is provided with the air conditioner 30 including the compressor 35, the storage battery 40, the demand receiver 24, the air-conditioning operation condition storage area 22*b* and air conditioner command generator 25 as an example of an air-conditioning controller, and the storage battery command generator 26 as an example of a charging controller. The air conditioner 30 is run by electric power. The storage battery 40 charges electric power and to supply stored electric power to the air conditioner 30. The demand receiver 24 receives a demand pertaining to the power consumption of the air conditioner 30 in the demand request period. The air-conditioning operation condition storage area 22*b* stores operation-associated information pertaining to the operation of the air conditioner 30, and the air conditioner command generator 25 controls the air conditioner 30. The storage battery command generator 26 controls the charging of the storage battery 40. The air conditioner command generator 25 causes the air conditioner 30 to perform precooling and/or to reduce the power consumption of the air conditioner 30 in the predetermined period as necessary, based on the demand and the amount of charge of the storage battery 40. The storage battery command generator 26 controls the charging of the storage battery 40 so that the storage battery 40 reaches, at the start of the demand request period, the state of charge determined based on the demand and the operation-associated information stored in the storage unit 22.

Because the state of charge of the storage battery 40 is determined based on the demand pertaining to the power consumption of the air conditioner 30 and the operation-associated information pertaining to the operation of the air conditioner 30, unnecessary charging is prevented and electric power can be efficiently utilized in the air conditioning system 10.

(4-2)

In the air conditioning system 10 of the present embodiment, the demand includes the length of the demand request period, the starting time of the demand request period, and information pertaining to the reduction amount of the power consumption of the air conditioner 30.

Because the state of charge of the storage battery 40 is determined based on the demand including length and starting time of the demand request period during which the power consumption of the air conditioner 30 is to be reduced, and the information pertaining to the reduction amount of the power consumption of the air conditioner 30, the state of charge of the storage battery 40 can be appropriately determined.

The demand herein includes the length of the demand request period, the starting time of the demand request period, and the reduction amount of the power consumption of the air conditioner 30, but is not limited thereto. For example, in cases such as when the length of the demand request period is uniformly decided in advance between the electric power company or electric power aggregator and the user who is using the air conditioning system 10, the demand may only include the starting time of the demand request period and information pertaining to the reduction amount of the power consumption of the air conditioner 30.

(4-3)

In the air conditioning system 10 of the present embodiment, the operation-associated information includes information pertaining to the set temperature of the air conditioner 30 scheduled for the demand request period (information pertaining to the set temperature of the air conditioner 30 for the demand request period, which is stored in the set temperature storage area 22*a*).

Because the state of charge of the storage battery 40 is determined based on the set temperature as an operating condition of the air conditioner 30 in the demand request period, the state of charge of the storage battery 40 can be appropriately determined.

(4-4)

In the air conditioning system 10 of the present embodiment, the operation-associated information includes the operating frequency of the compressor 35 of the air conditioner 30, the set temperature of the air conditioner 30, and the power consumption of the air conditioner 30 in a predetermined time span prior to the demand request period. In other words, the operation-associated information includes information pertaining to past operating conditions of the air conditioner 30, which is stored in the air-conditioning operation condition storage area 22*b*.

Because the state of charge of the storage battery 40 is determined based on the operating conditions of the air conditioner 30 prior to the demand request period, the state of charge of the storage battery 40 can be appropriately determined.

(4-5)

In the air conditioning system 10 of the present embodiment, the storage battery command generator 26 controls the charging rate of the storage battery 40, the charging start time of the storage battery 40, and the charging speed of the storage battery 40.

It is possible to appropriately control the state of charge of the storage battery 40 by controlling the charging rate, charging start time, and charging speed of the storage battery 40.

Second Embodiment

Figure 3:
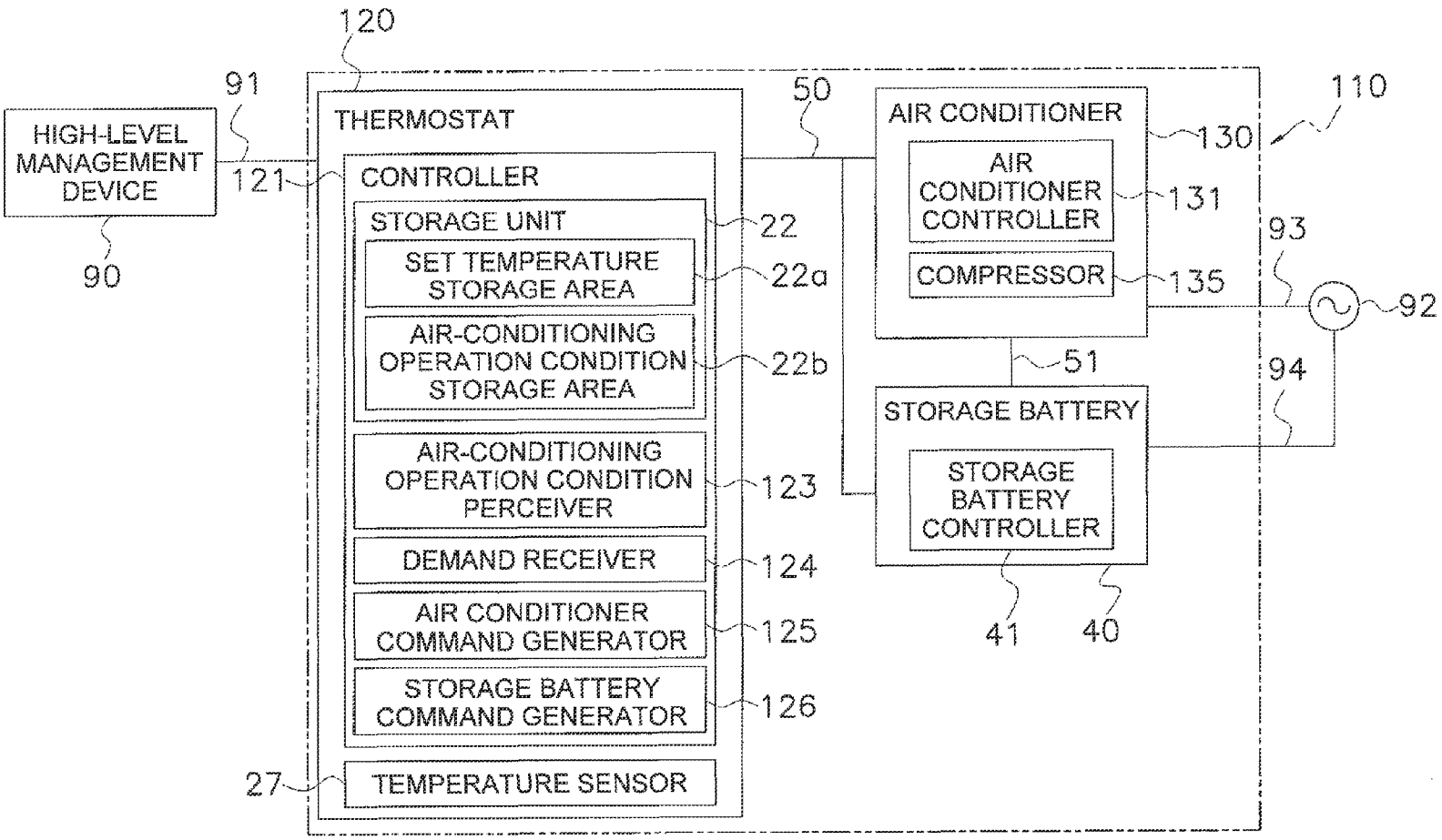
FIG. 3 is an overall schematic diagram of an air conditioning system according to the second embodiment of the present invention.

An air conditioning system 110 as an air conditioning system according to a second embodiment of the present invention shall be described, FIG. 3 is an overall schematic diagram of the air conditioning system 110 according to the second embodiment. In the following description of the second embodiment and FIG. 3, the same symbols as the first embodiment are sometimes used, meaning that configurations using the same symbols are the same as the configurations of the first embodiment. The air conditioning system 110 of the second embodiment has many points in common with the first embodiment, and different points are therefore primarily described.

(1) Overall Configuration

The air conditioning system 110 according to the second embodiment has different configurations for part of a thermostat 120 and part of an air conditioner 130, but is otherwise the same as the air conditioning system 10 according to the first embodiment (see FIG. 1). A description of the overall configuration here is omitted.

(2) Details (2-1) Thermostat

In the air conditioning system 110, a compressor 135 (see FIG. 3) of the air conditioner 130 is not an inverter-type compressor, but is operated at a constant speed (constant operating frequency) when running, as will be described hereinafter.

The differences in the thermostat 120 from the thermostat 20, arising from the compressor 135 not being an inverter-type compressor, are primarily described herein. Specifically, different points from the first embodiment are described, concerning an air-conditioning operation state perceiver 123, a demand receiver 124, an air conditioner command generator 125, and a storage battery command generator 126 of a controller 121.

(2-1-1) Air-Conditioning Operation State Perceiver

The air-conditioning operation state perceiver 123 differs from the air-conditioning operation state perceiver 23 of the first embodiment in that the air-conditioning operation state perceiver 123 may acquire the ratio between ON-time and OFF-time of the compressor 135 instead of the operating frequency of the compressor 135, as information pertaining to the operating condition of the air conditioner 130.

(2-1-2) Demand Receiver

The demand receiver 124 is the same as the demand receiver 24 of the first embodiment in that the demand receiver 124 is configured so as to receive a demand transmitted from the high-level management device 90.

In the second embodiment, the information pertaining to the reduction amount of the power consumption of the air conditioner 130, which is included in the demand received by the demand receiver 124, is different from that of the first embodiment. In the second embodiment, the information pertaining to the reduction amount of the power consumption of the air conditioner 130 is information on the temperature that the air conditioner 130 should raise (during cooling) or lower (during warming) relative to the set temperature stored in the set temperature storage area 22*a* during the demand request period. The information pertaining to the reduction amount of the power consumption of the air conditioner 130 is not limited to this option, and may also be information pertaining to a switching cycle of operation and stoppage (e.g., operating for one minute and at rest for two minutes or longer, etc.) that is allowed to the air conditioner 30 during the demand request period.

(2-1-3) Air Conditioner Command Generator

The air conditioner command generator 125 calculates the temperature difference between the current value measured by the temperature sensor 27, i.e. the current room temperature and the set temperature corresponding to the current day of week and time, and transmits a command to turn the air conditioner 130 on or off as a command for the air conditioner controller 131 when the temperature difference is a predetermined value or greater. The air conditioner command generator 125 instructs the air conditioner 130 to perform the air-cooling operation if the current room temperature is higher than the current set temperature by a predetermined value or more, and instructs the air conditioner 130 to perform the air-warming operation if the current room temperature is lower than the current set temperature by a predetermined value or more.

The air conditioner command generator 125 causes the air conditioner 130 to perform precooling before the demand request period and/or reduces the power consumption of the air conditioner 130 in the demand request period as necessary, based on the demand received by the demand receiver 124, the amount of charge of the storage battery 40, the operating condition of the air conditioner 130 stored in the air-conditioning operation condition storage area 22*b*, and other factors. The air conditioner command generator 125 may also cause the air conditioner 130 to perform preheating as necessary.

(2-1-4) Storage Battery Command Generator

The storage battery command generator 126 partially differs from the first embodiment in the method for generating the command for controlling the charging of the storage battery 40, for example.

Specifically, in step S2 of FIG. 2, the storage battery command generator 126 may, for example, find a plurality of times at which the set temperature value was equal to the set temperature of the air conditioner 130 during the demand request period from information pertaining to past operating conditions of the air conditioner 130, and may use information on the turning on and off of the compressor 135 of the air conditioner 130 during those times to predict the average power consumption of the air conditioner 130 during the demand request period. The method by which the storage battery command generator 126 predicts the average power consumption of the air conditioner 130 in the demand request period is exemplified here, and is not limited to this example.

Next, in step S3 of FIG. 2, the storage battery command generator 126 calculates the electric power that the air conditioner 130 can use during the demand request period based on the information pertaining to the reduction amount of the power consumption of the air conditioner 130, which was received by the demand receiver 124. This point is the same as in the first embodiment. However, the information pertaining to the reduction amount of the power consumption of the air conditioner 130 is information on the temperature that the air conditioner 130 should raise (during cooling) or lower (during warming) relative to the set temperature stored in the set temperature storage area 22*a* during the demand request period. A table, numerical formula, and/or the like prepared in advance in order to read the raised temperature or lowered temperature as the reduction amount of the power consumption for the information pertaining to the reduction amount of the power consumption of the air conditioner 130.

Next, in step S4, the storage battery command generator 126 calculates the difference between the average power consumption of the air conditioner 130 during the demand request period predicted in step S2 and the electric power that the air conditioner 130 can use during the demand request period calculated in step S3, and integrates this difference throughout the demand request period. The electric power that should be stored in the storage battery 40 is thereby calculated, and the storage state at the start of the demand request period is determined.

Other points are the same for both the storage battery command generator 126 and the storage battery command generator 26 of the first embodiment, and descriptions thereof are therefore omitted.

(2-2) Air Conditioner

The air conditioner 130 differs from the air conditioner 30 in that the compressor 135 is not an inverter-type compressor but is a fixed-speed compressor.

The air conditioner controller 131 of the air conditioner 130 controls the turning on and off of the compressor 135 in accordance with commands to turn the air conditioner 130 on and off transmitted from the air conditioner command generator 125 of the thermostat 120.

Other points are the same for both the air conditioner 130 and the air conditioner 30 of the first embodiment, and descriptions thereof are therefore omitted.

(3) Actions of Air Conditioning System

The actions of the air conditioning system 110 shall be described.

In the air conditioning system 110, set temperatures of the air conditioner 130 according to day of week and time are stored in the set temperature storage area 22*a* of the thermostat 120. The thermostat 120 generates an ON-command for the air conditioner controller 131 of the air conditioner 130 and transmits the command to the air conditioner controller 131 when the difference between the current room temperature measured by the temperature sensor 27 and the set temperature corresponding to the current day of week and time stored in the set temperature storage area 22*a* diverges by a predetermined value or more, and generates an OFF-command for the air conditioner controller 131 and transmits the command to the air conditioner controller 131 when the difference between the current room temperature and the current set temperature is less than a predetermined value.

The air conditioner 130 is basically operated without reducing the power consumption of the air conditioner 130 even during the demand request period. In other words, the air conditioner 130 is basically operated without changing the set temperature according to the demand (according to the set temperature stored in the set temperature storage area 22*a*) even during the demand request period. Insufficient electric power supply from the power source 92 to the air conditioner 130 is compensated by the storage battery 40.

However, the air conditioner command generator 125 causes the air conditioner 130 to perform precooling before the demand request period and/or reduces the power consumption of the air conditioner 130 in the demand request period as necessary, based on the demand received by the demand receiver 124, the amount of charge of the storage battery 40, the operating condition of the air conditioner 130 stored in the air-conditioning operation condition storage area 22*b*, and other factors.

The actions of the storage battery command generator 126 when the demand receiver 124 receives a demand and during the demand request period are the same as the first embodiment, and descriptions thereof are therefore omitted.

(4) Characteristics

The air conditioning system 110 has the same characteristics as those of (4-1), (4-2), (4-3), and (4-5) given as characteristics of the air conditioning system 10 of the first embodiment.

In the air conditioning system 110 of the present embodiment, the operation-associated information includes the ratio between ON-time and OFF-time of the compressor 135 of the air conditioner 130, the set temperature of the air conditioner 130, and the power consumption of the air conditioner 130 during a predetermined time span prior to the demand request period.

Because the state of charge of the storage battery 40 herein is determined based on the operating condition of the air conditioner 130 prior to the demand request period, the state of charge of the storage battery 40 can be appropriately determined.

Modifications

Modifications of the above embodiments are presented below. A plurality of modifications may be combined as appropriate.

(1) Modification A

In the first embodiment above, the air conditioning system 10 is provided with a thermostat 20 having a temperature sensor 27, but is not limited thereto.

For example, the air conditioning system 10 may be provided with, instead of the thermostat 20, an adaptor having the same functions as the controller 21 of the thermostat 20 described above. In this case, the air conditioner 30 preferably has a temperature sensor for measuring the room temperature.

In another configuration, the air conditioning system 10 may not have the thermostat 20, and the air conditioner controller 31 or storage battery controller 41 may have the same functions as the controller 21 of the thermostat 20 described above. Yet, in another configuration, the air conditioner controller 31 may has some of the functions of the controller 21 of the thermostat 20, while the storage battery controller 41 may has the other functions of the controller 21 of the thermostat 20. In this case, the air conditioner 30 preferably has a temperature sensor for measuring the room temperature.

In another option, even when the air conditioning system 10 has the thermostat 20, the air conditioner controller 31 and/or the storage battery controller 41 may have some or all of the functions of the controller 21 of the thermostat 20 described above.

(2) Modification B

In the above-described second embodiment, the air conditioner controller 131 and/or the storage battery controller 41 may have some or all of the functions of the controller 121 of the thermostat 120 described above.

(3) Modification C

In the first embodiment described above, the storage battery command generator 26 starts an action such as determining the state of charge of the storage battery 40 on the condition that the demand receiver 24 receives the demand, but is not limited to doing so. For example, the storage battery command generator 26 may be configured so as to start determining the state of charge of the storage battery 40 before a predetermined time duration prior to the starting time of the demand request period. The same applies to the second embodiment.

The present invention is useful as an air conditioning system comprising an air conditioner and a storage battery, electric power stored in the storage battery being utilized in the air conditioner in accordance with a demand pertaining to power consumption, wherein unnecessary charging of electric power in the storage battery is prevented and electric power can be efficiently utilized.

What is claimed is:

1. An air conditioning system comprising:

an air conditioner run by electric power and including a compressor, a storage battery configured to charge electric power and to supply stored electric power to the air conditioner;

a demand receiver configured to receive a demand request to suppress a power consumption of the air conditioner during a predetermined period;

an air-conditioning controller configured to store operation-associated information pertaining to operation of the air conditioner and to control the air conditioner, and a charging controller configured to control the charging of the storage battery, the air-conditioning controller being configured to cause the air conditioner to reduce the power consumption of the air conditioner in the predetermined period based on the demand request and an amount of charge of the storage battery, the charging controller being configured to acquire a current amount of charge of the storage battery, determine a required amount of charge of the storage battery to be reached at a start of the predetermined period to satisfy the demand request received by the demand receiver, the required amount of charge being determined based on the demand request and the operation-associated information, control the charging of the storage battery based on the current amount of charge so that the storage battery reaches the required amount of charge at the start of the predetermined period.

2. The air conditioning system according to claim 1, wherein the demand includes at least one of a length of the predetermined period, a starting time of the predetermined period, and information pertaining to a reduction amount of the power consumption of the air conditioner.

3. The air conditioning system according to claim 2, wherein the operation-associated information includes information pertaining to a set temperature of the air conditioner scheduled for the predetermined period.

4. The air conditioning system according to claim 2, wherein the operation-associated information includes at least one of an operating frequency of the compressor, a ratio between ON-time and OFF-time of the compressor, a set temperature of the air conditioner, and a power consumption of the air conditioner in a predetermined time span prior to the predetermined period.

5. The air conditioning system according to claim 2, wherein the charging controller is configured to control at least one of a charging rate of the storage battery, a charging start time of the storage battery, and a charging speed of the storage battery.

6. The air conditioning system according to claim 1, wherein the operation-associated information includes information pertaining to a set temperature of the air conditioner scheduled for the predetermined period.

7. The air conditioning system according to claim 6, wherein the operation-associated information includes at least one of an operating frequency of the compressor, a ratio between ON-time and OFF-time of the compressor, a set temperature of the air conditioner, and a power consumption of the air conditioner in a predetermined time span prior to the predetermined period.

8. The air conditioning system according to claim 6, wherein the charging controller is configured to control at least one of a charging rate of the storage battery, a charging start time of the storage battery, and a charging speed of the storage battery.

9. The air conditioning system according to claim 1, wherein the operation-associated information includes at least one of an operating frequency of the compressor, a ratio between ON-time and OFF-time of the compressor, a set temperature of the air conditioner, and a power consumption of the air conditioner in a predetermined time span prior to the predetermined period.

10. The air conditioning system according to claim 9, wherein the charging controller is configured to control at least one of a charging rate of the storage battery, a charging start time of the storage battery, and a charging speed of the storage battery.

11. The air conditioning system according to claim 1, wherein the charging controller is configured to control at least one of a charging rate of the storage battery, a charging start time of the storage battery, and a charging speed of the storage battery.

* * * * *